US010460590B2

(12) United States Patent
Strack

(10) Patent No.: US 10,460,590 B2
(45) Date of Patent: Oct. 29, 2019

(54) METHOD AND SYSTEM FOR MOBILE DURESS ALARM

(71) Applicant: Tyco Integrated Security, LLC, Boca Raton, FL (US)

(72) Inventor: Darryl Strack, Charlotte, NC (US)

(73) Assignee: TYCO INTEGRATED SECURITY, LLC, Boca Raton, FL (US)

( * ) Notice: Subject to any disclaimer, the term of this patent is extended or adjusted under 35 U.S.C. 154(b) by 0 days.

(21) Appl. No.: 15/220,126

(22) Filed: Jul. 26, 2016

(65) Prior Publication Data

US 2018/0033288 A1 Feb. 1, 2018

(51) Int. Cl.
*G08B 25/01* (2006.01)
*G08B 27/00* (2006.01)
*G08B 25/00* (2006.01)

(52) U.S. Cl.
CPC ..... *G08B 25/016* (2013.01); *G08B 27/001* (2013.01); *G08B 25/006* (2013.01)

(58) Field of Classification Search
CPC ..... G08B 25/016; G08B 27/001
See application file for complete search history.

(56) References Cited

U.S. PATENT DOCUMENTS 6,412,207 B1 * 7/2002 Crye ..... F41A 17/02 42/70.01
6,823,621 B2 * 11/2004 Gotfried ..... F41A 17/066 42/70.01
6,918,519 B2 * 7/2005 Vor Keller ..... E05B 47/0603 224/188
8,116,724 B2 * 2/2012 Peabody ..... G08B 25/016 455/404.2
8,630,820 B2 * 1/2014 Amis ..... G01S 19/16 455/404.1
8,830,054 B2 * 9/2014 Weiss ..... G08B 25/001 340/539.11
9,154,740 B2 * 10/2015 Levinson ..... H04N 7/18
9,185,536 B1 * 11/2015 Johnson ..... H04W 4/16
9,338,627 B1 * 5/2016 Singh ..... G06F 3/0416
9,395,132 B2 * 7/2016 Stewart ..... F41A 17/063
9,404,698 B2 * 8/2016 Stewart ..... F41A 17/063
9,418,537 B2 * 8/2016 Cahill ..... G08B 25/008
9,426,638 B1 * 8/2016 Johnson ..... H04W 4/90
9,483,932 B2 * 11/2016 Amis ..... G01S 19/16
9,495,860 B2 * 11/2016 Lett ..... G08B 25/001
9,606,721 B2 * 3/2017 Park ..... G06F 3/0488
9,642,131 B2 * 5/2017 Bohlander ..... H04W 4/025
9,658,012 B2 * 5/2017 Stewart ..... F41A 17/063
9,658,013 B2 * 5/2017 Stewart ..... F41A 17/063
9,843,915 B2 * 12/2017 Bohlander ..... H04W 4/02
2001/0029321 A1 * 10/2001 Beetz ..... A61N 1/37 600/300

(Continued)

*Primary Examiner* — Joseph H Feild
*Assistant Examiner* — Rufus C Point
(74) *Attorney, Agent, or Firm* — HoustonHogle LLP

(57) ABSTRACT

During a potential security event, a mobile application enters an alarm state and records audio, video and location event data and forwards the event data to a monitoring center, which stores the event data and takes appropriate action such as notifying local law enforcement. The alarm state is triggered manually, by the use of wireless sensors, or by arming the mobile application and then determining if it has been disarmed within a predetermined period of time.

20 Claims, 14 Drawing Sheets

(56) References Cited

U.S. PATENT DOCUMENTS

2002/0072348 A1* 6/2002 Wheeler ..... G08B 25/016 455/404.2
2004/0152961 A1* 8/2004 Carlson ..... A61B 5/1112 600/301
2006/0208857 A1* 9/2006 Wong ..... F41C 33/0209 340/5.82
2008/0222565 A1* 9/2008 Taylor ..... G05B 15/02 715/810
2009/0231125 A1* 9/2009 Baldus ..... A61B 5/0006 340/539.12
2010/0285771 A1* 11/2010 Peabody ..... G08B 25/016 455/404.2
2011/0046920 A1* 2/2011 Amis ..... G01S 19/16 702/181
2011/0275435 A1* 11/2011 Torre ..... A63F 13/42 463/37
2011/0281550 A1* 11/2011 Peabody ..... G08B 25/016 455/404.2
2012/0108999 A1* 5/2012 Leininger ..... A61B 5/0004 600/546
2012/0220835 A1* 8/2012 Chung ..... A61B 5/0022 600/301
2013/0005294 A1* 1/2013 Levinson ..... H04N 7/18 455/404.2
2013/0007788 A1* 1/2013 Levinson ..... H04N 7/18 725/13
2013/0214925 A1* 8/2013 Weiss ..... G08B 25/001 340/539.11
2013/0231077 A1* 9/2013 Cahill ..... G08B 25/008 455/404.2
2014/0167955 A1* 6/2014 Mahajan ..... G08B 21/0269 340/539.12
2014/0273849 A1* 9/2014 Lee ..... G06F 1/1694 455/41.2
2014/0366421 A1* 12/2014 Arif ..... F41A 17/063 42/70.11
2015/0009011 A1* 1/2015 Cahill ..... G08B 25/008 340/7.58
2015/0173674 A1* 6/2015 Hayes ..... A61B 5/681 600/301
2015/0369559 A1* 12/2015 Del Rosario ..... F41C 33/029 340/686.4
2016/0173832 A1* 6/2016 Stewart ..... F41A 17/20 348/158
2016/0196733 A1* 7/2016 Brasch ..... G08B 21/0407 340/573.4
2016/0270740 A1* 9/2016 Raisoni ..... A61B 5/746
2016/0286156 A1* 9/2016 Kovac ..... H04N 5/772
2016/0321903 A1* 11/2016 Smits ..... G06F 19/3418
2016/0345874 A1* 12/2016 Raisoni ..... A61B 5/002
2017/0031449 A1* 2/2017 Karsten ..... G06F 19/3418
2017/0142316 A1* 5/2017 Bohlander ..... H04N 5/77
2017/0160041 A1* 6/2017 Stewart ..... F41A 35/00
2017/0316675 A1* 11/2017 Bauer ..... G08B 21/0269
2019/0110181 A1* 4/2019 Kavantsaari ..... H04L 67/24

* cited by examiner

| User ID | Instant Alarm Events | Instant Alarm Actions | Arming Events | Expiration Actions | Disarming Actions | Max Reset Count | Notification List |
|---|---|---|---|---|---|---|---|
| EMP001 | Manual | Text Contacts; Call Police | Manual | Text Contacts; Call Police | Delete A/V, GPS data | 10 | Coworker1, Supervisor1 |
| EMP002 | Pepper spray; Manual | Text Contacts; Call Police | Geofencing; Manual | Text Contacts; Call Police | Delete A/V, GPS data | 10 | Coworker2, Coworker3, Supervisor2 |
| EMP003 | Gun drawn; Manual | Notify nearby offices; Notify Dispatch | Manual | Dispatch backup officers | Delete A/V, GPS data | 5 | NearbyOfficers, Dispatch, Supervisor |
| ⋮ | | | | | | | |
| EMP N | Criteria n | Action List n | Criteria n | Action List n | Action List n | Max Reset n | List n |

120

| Event ID | User ID | Begin (date/time) | End (date/time) | Location | Event Type | Reset Count | Status | Actions Taken | Incident Report | Audio/ Video Files |
|---|---|---|---|---|---|---|---|---|---|---|
| Event1 | EMP001 | time1 | time2 | Location1 | Closing (late) | 4 | Complete | - | Report1 | - |
| Event2 | EMP001 | time3 | time4 | Location1 | SOS-timer exp. | 0 | Complete | Texted contacts; Called police | - | File1 |
| Event3 | EMP001 | time5 | - | Location1 | SOS-manual | - | In Progress | Texted contacts; Called police | Report2 | File2 |
| Event4 | EMP002 | time6 | time7 | Location2 | Branch opening | 2 | Complete | - | - | - |
| Event5 | EMP002 | time8 | time9 | Location2 | SOS-pep. spray | - | Complete | Texted contacts; Called police | - | File3 |
| Event6 | EMP002 | time10 | - | Location2 | SOS-timer exp. | 0 | In Progress | Texted contacts; Called police | Report3 | File4 |
| Event7 | EMP003 | time11 | time12 | Location3 | SOS-timer exp. | 0 | Complete | Dispatched nearby officers | - | File5 |
| Event8 | EMP003 | time13 | - | Location4 | SOS-gun drawn | - | In Progress | Dispatched nearby officers | - | File6 |
| ⋮ | | | | | | | | | | |
| Event n | EMP n | Begin n | End n | Location n | Event Type n | Reset n | Status n | Actions n | Report n | File n |

122

124

| Incident Report ID | Time Created | Time Updated | Status | Uploaded Photos | User Entered Text |
|---|---|---|---|---|---|
| Report1 | time14 | time15 | Complete | Photo1 | Suspicious vehicle parked outside Branch 123 |
| Report2 | time16 | time17 | Complete | Photo2 | Broken window discovered during opening process |
| Report3 | time18 | - | Pending | Photo3 | Suspicious object |

FIG. 2

METHOD AND SYSTEM FOR MOBILE DURESS ALARM

BACKGROUND OF THE INVENTION

Entities such as companies and agencies in which there is significant risk of harm to employees or agents often use personal security systems to mitigate the risk. Some examples of the entities include banks, check cashing companies, pawn shops, realtors, private security companies, insurance companies, law enforcement agencies, and individual citizens, among others.

A trend has been to implement these personal security systems on mobile computing devices (e.g. applications or apps executing on smart phones or tablet devices). These devices work in cooperation with a monitoring center. The monitoring center can be administered by the entity, a third party company (for example, a private security company), or a law enforcement agency. In one example, the employee or agent calls the monitoring center directly to report a suspicious individual. In another example, the employee or agent calls the monitoring center directly at the beginning of a routine sequence of actions and stays on the call with the monitoring center until the employee or agent verbally confirms that they have completed the sequence (for example, opening a branch of a bank or check cashing service and stays on the phone with the monitoring center until they have arrived safely at the branch and the opening process is complete).

Personal security systems have also included a trigger mechanism that, when activated, causes the mobile application executing on the mobile computing device to contact the monitoring center and/or activate other security features. Examples of the trigger mechanism include a virtual panic button.

Some personal security systems record information about the user's surroundings. This information can be forwarded to the monitoring center and/or to a law enforcement agency to be used in investigating a security event and providing aid to users involved in a security event. Typically, mobile computing devices include various mechanisms by which information about the surrounding environment can be recorded. Examples include microphones for recording audio information, cameras for recording video information, and global navigation satellite system receivers for determining location information (for example, GPS coordinates). In one example, audio and video information is recorded in response to a particular event, such as the user pressing the virtual panic button. In another example, the mobile application records audio and video information continuously initiated by a countdown timer elapsing, but then records audio and video information at a higher frame rate in response to the user pressing the virtual panic button.

SUMMARY OF THE INVENTION

One common problem with many proposed systems is that they require the user of the mobile computing device to take action in some way to activate the security features. As a result, they do not always increase the safety of the user or the user's environment in situations in which the user cannot perform the action required to activate the security features. For example, an employee of a bank can become incapacitated before they are able to press the virtual panic button. In a further example, a security guard or law enforcement officer could be preoccupied by a dangerous incident and thus unable to call for backup. In both situations, the amount of time that passes before the user is able to actively trigger the security features of the mobile application decreases the effectiveness of the personal security system.

The intent of the invention is to record information from the user's surroundings and/or notify the monitoring center when the user has limited time to, or is unable to, actuate a trigger mechanism such as the virtual panic button.

One embodiment implements a trigger mechanism that can be activated with limited or no user input when the mobile application detects a potential security event. Upon activation of the trigger mechanism, the mobile application can enter an alarm state, which indicates that a potential security event has occurred at the user's location. In an alarm state, the mobile application might begin recording and/or sending information from the user's surroundings, including audio, video and location information. This information is sent to the monitoring center along with possibly an alert indicating that there is a potential security event. The audio, video and location information is then stored and monitored by a technician at the monitoring center. An alert can be sent to a predetermined list of contacts (for example, a text message is sent to the user's coworkers warning them not to approach). Local law enforcement is notified and provided with the audio, video and location information.

The trigger mechanism for causing an alarm state can be activated by the user pressing and holding a physical button of the device such as the "volume up" button for a predetermined period of time, or by the user pressing a wireless alarm button on the body of the user (for example, clipped to the user's belt), or a virtual button displayed on the device's touchscreen display, among other examples. On the other hand, the trigger mechanism can also be activated automatically, with no specific action by the user, when the mobile application detects (via wireless sensors) that the user has unholstered their weapon or discharged pepper spray, among other examples.

Another embodiment implements a mobile duress timer, which is a timer set and initiated by the user any time that there is a risk of incapacitation. The timer can be extended, paused or deactivated by the user. When the timer is initiated, audio, video and location information is recorded by the mobile application and possibly buffered at a monitoring center. Certain predetermined actions are performed if the user deactivates the timer (for example, the recorded information is discarded). On the other hand, if the timer expires, the mobile application enters an alarm state, and the information is sent to the monitoring center. A proper analysis and response can thus be initiated immediately upon expiration of the mobile duress timer without further acts by the user.

The mobile duress timer can be started by the user pressing a button or series of physical or virtual buttons displayed on the touch screen display of the user's mobile computing device, for example. On the other hand, the duress timer can also be started automatically, with no input from the user. For example, the app executing on the device can start the duress timer automatically when it detects, via geo-fencing, that the user is in a location where the risk of harm is significant by reference to location information generated by the GPS chipset in the device.

In one example, the user is an employee of a bank who is responsible for opening a branch of the bank. As the user arrives at the bank branch, they start the duress timer by pressing a button on the mobile application. The mobile application begins recording audio, video and location information. After completing the bank branch opening process, they deactivate the duress timer, and the recorded information is possibly immediately discarded. On the other hand, if the user becomes incapacitated (for example, if attacked and becomes unconscious), the duress timer expires, and the mobile application enters an alarm state. The recorded information is sent to the or moved from a buffer in monitoring center, stored, and monitored, the local police are notified, and a text message is sent to other employees of the bank branch warning them not to approach the bank branch, in one specific example.

In another example, the user is an employee of a check cashing company who is responsible for opening a store branch. As the user arrives at the branch, the mobile application detects (via geo-fencing) arrival at the branch at the approximate time that the branch is scheduled to open, and the duress timer starts automatically, and audio, video and location information is recorded. When the opening process has been completed, the employee deactivates the timer, and the information is discarded.

In another example, the user is an employee of a company who is leaving work at a late hour and notices a suspicious looking group of people near their car. In one specific example, the employee might press the volume up button on their mobile device for longer than three seconds, which arms the device and starts the duress timer. The app executing on the device begins recording audio, video and location information and possibly starts sending this information to the monitoring center. When the user is safely in their car, the duress timer is deactivated, and the information is discarded.

In another example, the user is an employee of a bank who is inspecting an abandoned/foreclosed property owned by the bank. As the user arrives at the abandoned property, the mobile application detects (via geo-fencing) the arrival at a property that is known to be abandoned, and the duress timer starts automatically.

In another example, the user is a police officer who removes his gun from its holster. The mobile application detects that the gun has been removed from its holster (via a wireless sensor) and automatically enters an alarm state. Audio, video and location information is recorded and sent to the monitoring center, and an alert is sent to the nearest active police officers informing them that a potential lethal event is occurring.

In this way, the personal security system initiates responses to security events with limited or no input from the user, thus decreasing the amount of time necessary to respond, and increasing the effectiveness of the security system at preventing or mitigating harm to users during a security event as well as pre-event and historical audio and video.

In general, according to one aspect, the invention features a method for responding to potential security events. The method comprises specifying alarm events and configuring a set of alarm actions to be performed in response to detecting the alarm events. A mobile application, executing on a mobile computing device, detects the alarm events, records event data and forwards the event data to a monitoring center in response to detecting the alarm events. The monitoring center executes the alarm actions and stores the received event data.

In embodiments, the alarm events include a manual activation event that is triggered by pressing one or more buttons on the mobile computing device in a predetermined manner and an activation event that is detected by a wireless body sensor. The alarm actions can include notifying a predetermined list of contacts of the potential security event and/or notifying nearby law enforcement officers of the potential security event. The monitoring center can be a law enforcement agency, and the alarm actions can include dispatching backup law enforcement officers to the location of a potential security event. The event data includes audio, video, and global navigation satellite system location data recorded by the mobile application.

In general, according to another aspect, the invention features a method for responding to potential security events. The method comprises specifying one or more arming events, expiration actions, and disarming actions. A mobile application executing on a mobile computing device detects the arming events, records event data, forwards the event data to a monitoring center, and determines whether the mobile application has been disarmed in response to the arming events. Actions are executed in response to failing to detect disarming actions.

In general, according to another aspect, the invention features a mobile duress alarm system. The system comprises a mobile computing device executing a mobile application for detecting alarm events and recording event data and forwarding the event data to a monitoring center in response to detecting the alarm events. The monitoring center executes alarm actions to be performed in response to detecting the alarm events and stores the received event data.

In embodiments, the alarm events include a manual activation event that is triggered by pressing one or more buttons on the mobile computing device in a predetermined manner and an activation event that is detected by a wireless body sensor. The alarm actions include notifying a predetermined list of contacts and/or law enforcement of the potential security event. The monitoring center can be a law enforcement agency, and the alarm actions can include dispatching backup law enforcement officers to the location of a potential security event. The event data includes audio, video and global navigation satellite system location data recorded by the mobile application.

In general, according to another aspect, the invention features a mobile duress alarm system. The system comprises a mobile computing device executing a mobile application. The application can detect arming events, record event data, and forward the event data to a monitoring center. It also determines whether the mobile application has been disarmed in response to the arming events. The monitoring center will then execute actions in response to failing to receive an indication that the mobile application was disarmed.

The above and other features of the invention including various novel details of construction and combinations of parts, and other advantages, will now be more particularly described with reference to the accompanying drawings and pointed out in the claims. It will be understood that the particular method and device embodying the invention are shown by way of illustration and not as a limitation of the invention. The principles and features of this invention may be employed in various and numerous embodiments without departing from the scope of the invention.

BRIEF DESCRIPTION OF THE DRAWINGS

In the accompanying drawings, reference characters refer to the same parts throughout the different views. The drawings are not necessarily to scale; emphasis has instead been placed upon illustrating the principles of the invention. Of the drawings:

FIG. 2 is a diagram of a user profile database, event log and incident report database of the mobile duress alarm system;

DETAILED DESCRIPTION OF THE PREFERRED EMBODIMENTS

The invention now will be described more fully hereinafter with reference to the accompanying drawings, in which illustrative embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art.

As used herein, the term "and/or" includes any and all combinations of one or more of the associated listed items. Further, the singular forms and the articles "a", "an" and "the" are intended to include the plural forms as well, unless expressly stated otherwise. It will be further understood that the terms: includes, comprises, including and/or comprising, when used in this specification, specify the presence of stated features, integers, steps, operations, elements, and/or components, but do not preclude the presence or addition of one or more other features, integers, steps, operations, elements, components, and/or groups thereof. Further, it will be understood that when an element, including component or subsystem, is referred to and/or shown as being connected or coupled to another element, it can be directly connected or coupled to the other element or intervening elements may be present.

Figure 1A:
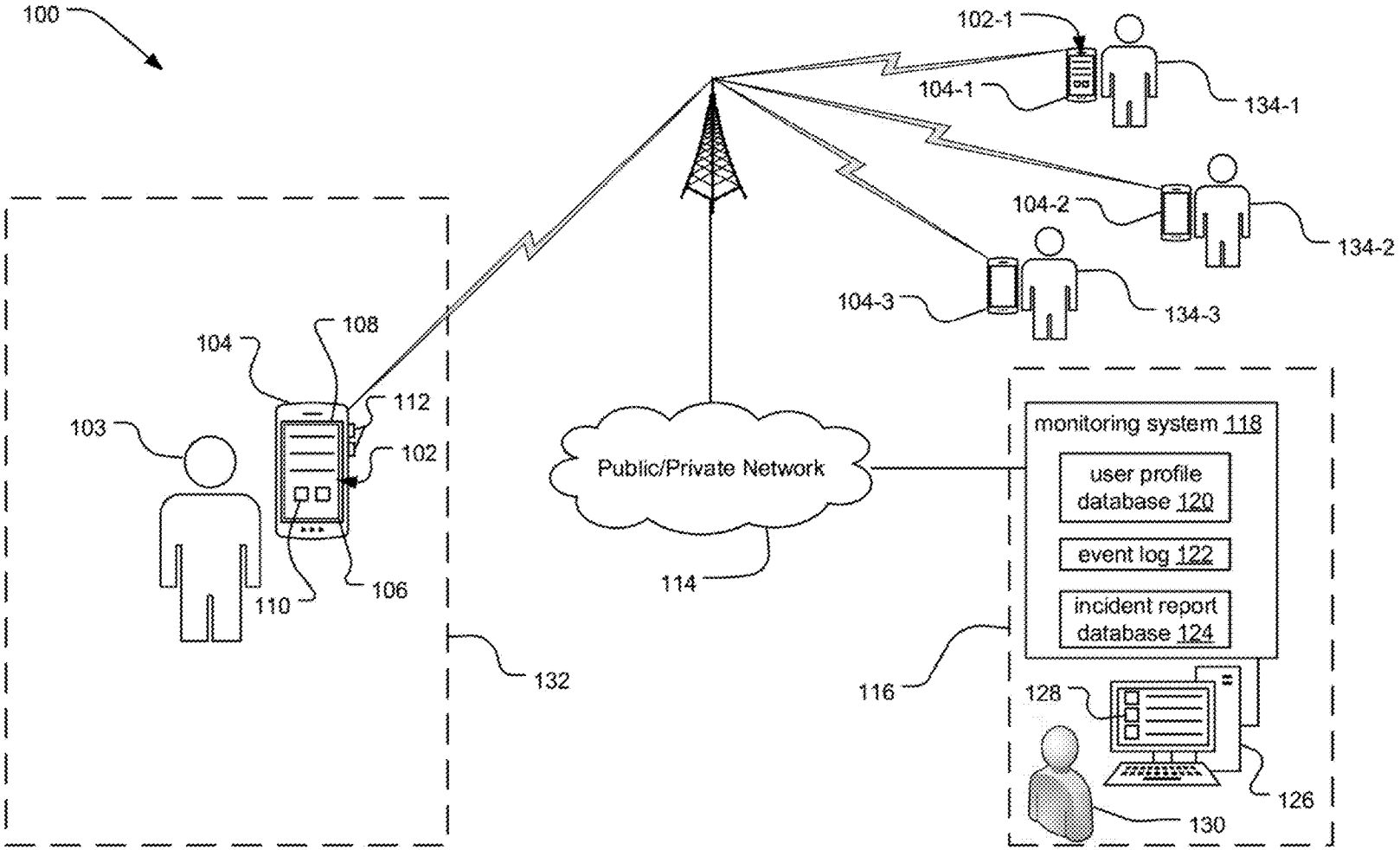
FIG. 1A is a block diagram of a mobile duress alarm system according to the present invention.

FIG. 1A is a block diagram of a mobile duress alarm system 100 constructed according to the principles of the present invention.

The system 100 includes a mobile and/or embedded application 102 executing on a mobile computing device 104 (e.g. a smart phone, tablet, etc.) and a monitoring center 116 connected via a network 114. The network 114 can be a public network (such as the internet), a private network (such as a corporate network) or a combination public and private network.

The mobile application 102 receives input from the user 103 and the user's environment. The mobile computing device 104 includes a graphical user interface (GUI) 106 rendered on a display 108 (e.g. a touchscreen display). The GUI 106 includes various screens that communicate information to the user 103 and enable the user 103 to input information by selecting virtual buttons and keys (for example, of a keyboard). In one example, virtual buttons are displayed on the screens of the GUI as shapes and/or text. The text and shapes communicate to the user what input option the virtual button represents. The mobile computing device 104 also typically includes physical buttons 112, which are on the outside of the mobile computing device (for example, the volume up and volume down buttons of a smart phone). The mobile application 102 also records data from various components of the mobile computing device 104 such as the microphone, camera or global navigation satellite system (GNSS) receiver chipset. Additionally, in some embodiments, the mobile computing device 104 receives input from various external components such as wireless buttons and sensors.

In general, during a potential security event, which is an event during which a user 103 is inferred to be in danger or incapacitated, the mobile application 102 accesses and records event data. Some examples of event data are audio data recorded by a microphone, video data recorded by a camera, and location data recorded by a GNSS receiver (for example, a GPS receiver). The event data is sent to the monitoring center 116 over the network 114, and the monitoring center 116 monitors the event data and responds according to the information received by the mobile application 102.

The mobile application 102 determines that a potential security event exists based on a combination of user input and detected information about the user 103 and the user's surroundings. For example, the user 103 can press a predetermined physical button 112, virtual button 110, or wireless button to trigger a potential security event directly. On the other hand, a potential security event can be automatically inferred to exist based on information such as the amount of time elapsed since the detection of user input by the mobile application 102, or the detection by the mobile application 102 that the user 103 has entered a certain geographical location, among other examples.

The monitoring center 116 includes a monitoring system 118, a user profile database 120, an event log 122, an incident report database 124, one or more workstations 126, a monitoring center application 128 and one or more technicians or operators 130. The user profile database 120 includes a list of the criteria for determining whether a potential security event exists and actions to be taken by the monitoring center 116 in response to the potential security event. During a potential security event, the monitoring system 118 receives event data and stores it in the event log 122, which is a database that stores data pertaining to potential security events such as the ID of the involved user 103, the date, time and location, and the status, among other information. The incident report database 124 stores information that is potentially relevant to potential security events and that is directly reported by the user 103 (for example, by using the mobile application 102 to fill out and submit a form). The monitoring center application 128 executing on the workstation 126 accesses and displays information from the user profile database 120, event log 122 and incident report database 124, which is monitored by the technician 130. Actions in response to potential security events are then initiated by the technician 130 and/or out wally by the monitoring center application 128.

In one embodiment, the monitoring center 116 is administered by an entity that employs the user 103. In another embodiment, the monitoring center 116 is administered by a third party entity (for example, a third party security company). In another embodiment, the monitoring center 116 is a law enforcement agency such as a dispatch center.

Among other actions, in response to a potential security event, the monitoring center 116 sends alert messages to contacts 134 of the user 103, which are individuals to be notified of a potential security event. Examples of contacts 134 include coworkers, supervisors, family members, and emergency contacts. The contacts 134 of each user 103 are listed in the user profile database 120. In the illustrated embodiment, contacts 134 are notified of the potential security event via mobile computing devices 104 connected to the network 114. In one embodiment, the contact 134-1 receives notification of a potential security event via a message displayed on the mobile application 102-1 executing on the mobile computing device 104-1. In other embodiments, the contacts 134 receive notification of a potential security event via telephone, voicemail, text message, email, among other examples.

Figure 1B:
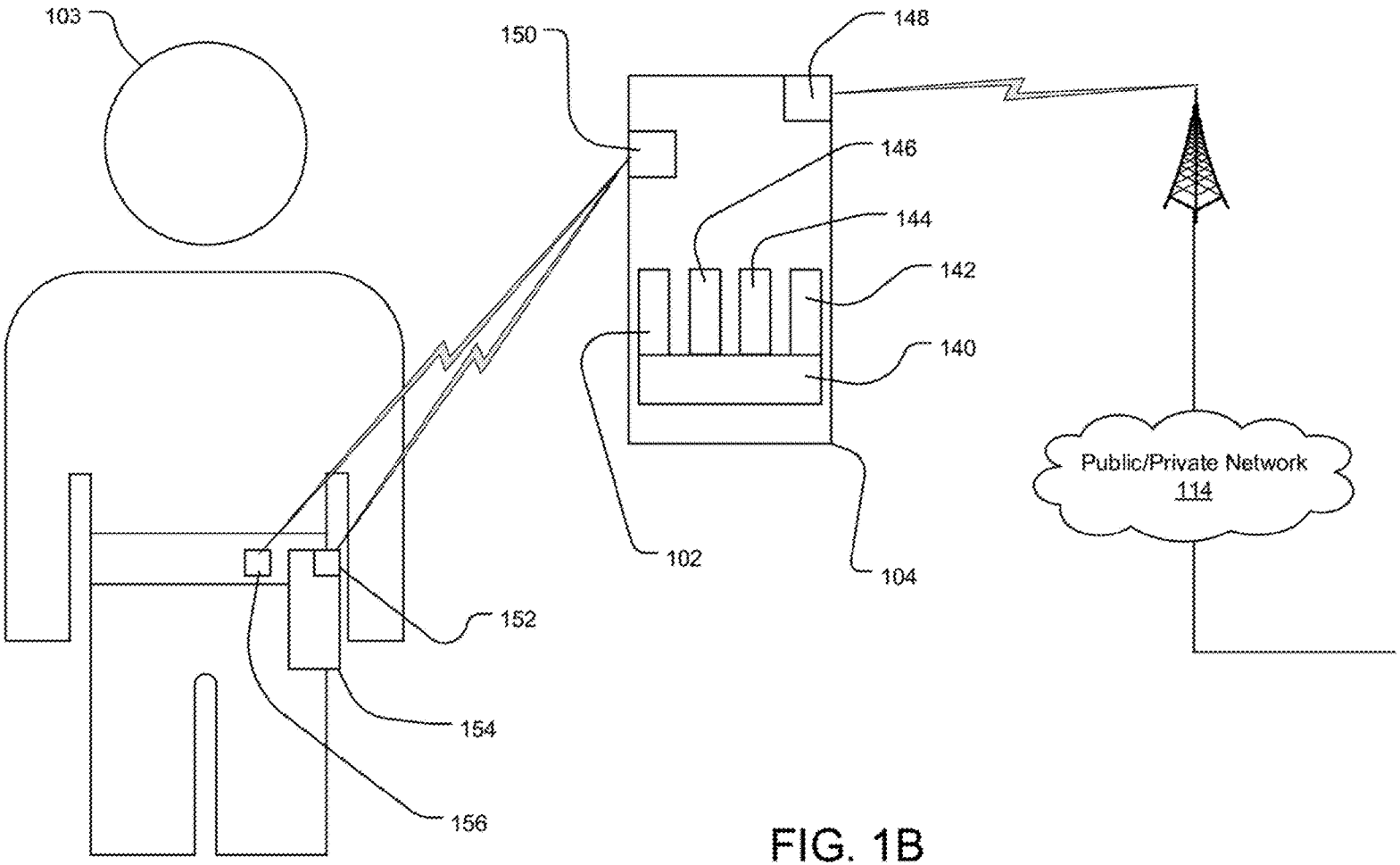
FIG. 1B is a block diagram of a mobile application of a mobile duress alarm system executing on the mobile computing device according to the present invention.

FIG. 1B is a block diagram showing the mobile application 102 executing on the mobile computing device 104. The mobile computing device 104 includes an operating system 140, a wide area network (WAN) process 142, a Bluetooth process 144, a GNSS receiver process 146, a WAN interface 148, and a Bluetooth interface 150. The operating system 140 directs the basic functionality of the mobile computing device 104, including the WAN process 142, Bluetooth process 144, GNSS receiver process 146 and the mobile application 102. The wide area network process 142 sends and receives data to and from the operating system 140 and the wide area network interface 148, which in turn connects wirelessly to the network 114, for example, via WiFi or a cellular data service. The Bluetooth process 144 sends and receives data to and from the operating system 140 and the Bluetooth interface 150, which in turn connects wirelessly to devices such as a wireless sensor 152 or a wireless alarm button 154. It should be noted that the mobile computing device 104 includes various other processes and interfaces that are not illustrated.

The wireless sensor 152 is attached to a holster 154 for a weapon such as a gun, pepper spray, or an electro-shock weapon, or to the weapon itself. In one embodiment, the sensor 152 sends an alarm signal to the mobile application 102, via a BlueTooth connection when a gun or electro-shock weapon is removed from the holster 154. In another embodiment, the sensor 152 sends an alarm signal to the mobile application 102 when pepper spray is discharged.

The wireless alarm button 156 is attached to the body of the user 103 and sends an alarm signal to the mobile application 102 when the button is pressed by the user 103.

In other embodiments, the mobile duress alarm system 100 interfaces with other external devices that are not illustrated, including devices that allow connectivity at the device or database level.

FIG. 2 is a diagram of the user profile database 120, event log 22 and incident report database 124.

In general, the user profile database 120 stores configuration settings for each user related to how it is determined that a potential security event exists and what actions will be taken in response. These configuration settings can be specified by the individual user 103 or by a party associated with the individual user 103, such as the user's employer or a security contractor or are specified as part of profiles associated with different types of users, among other examples. When a potential security event is determined to exist, the mobile application 102 enters an alarm state, which is a state during which information about the user and the user's surroundings is recorded by the mobile application 102 and forwarded to the monitoring center 116, and during which the monitoring center 116 takes certain actions in response to the potential security event. The user profile database 120 includes instant alarm events, instant alarm actions, arming events, expiration actions, disarming actions, a maximum reset count, and a notification list for each user 103. Instant alarm events are events that will directly trigger the mobile application 102 to enter an alarm state. Instant alarm actions are actions to be taken by the monitoring center 116 in response to instant alarm events. Arming events are events that will arm the mobile application 102. When the mobile application 102 is armed, the armed state of the application can be disarmed, extended, or allowed to expire. If the armed state of the mobile application 102 is allowed to expire, an alarm event will be triggered. On the other hand, if the mobile application 102 is disarmed, it is determined that no potential security event exists, and an alarm event is not triggered. Expiration actions are actions taken by the monitoring center 116 when the mobile application 102 is not disarmed and the armed state of the mobile application 102 is allowed to expire. Disarming actions are events taken by the monitoring center 116 when the mobile application is disarmed. The maximum reset count is the maximum number of times that the armed state of the mobile application 102 can be extended before an alarm state is triggered.

In one embodiment, a duress timer is used to determine the armed or disarmed status of the mobile application 102. In this example, when the mobile application 102 is armed, the duress timer starts at a predetermined amount of time and counts down. When the duress timer reaches zero, the armed state of the mobile application 102 expires, and the mobile application 102 enters an alarm state. When the duress timer is extended, additional time is added to the duress timer, and, in effect, the amount of time between the start of the duress timer and potential expiration increases. Finally, when the duress timer is paused, it temporarily stops counting down.

Additionally, the user profile database 120 also includes a user ID and a notification list, which is a list of contacts 134 to be notified by the monitoring center 116 during a potential security event, after the mobile application 102 has entered an alarm state and notified the monitoring center 116.

In the illustrated example, the user EMP001's instant alarm events include "Manual", which indicates that an alarm event will be triggered if the user 103 presses a predetermined sequence of virtual buttons 110, physical buttons 112, or wireless alarm buttons 156. EMP001's instant alarm actions include "Text Contacts" and "Call Police", which indicates that when the mobile application 102 enters an alarm state, the monitoring center 116 will send a text message to the contacts 134 "Coworker1" and "Supervisor1" in the user's 103 notification list, and the monitoring center 116 will notify local law enforcement of the potential security event. EMP001's aiming events include "Manual", which indicates that the mobile application 102 will be armed if the user 103 presses a predetermined sequence of virtual buttons 110, physical buttons 112, or wireless alarm buttons 156. The expiration actions for EMP001 include "Text Contacts" and "Call Police", which indicates that when the armed status of the mobile application 102 is allowed to expire (and the mobile application 102 thus enters an alarm state), the monitoring center 116 will send a text message to the contacts 134 in the notification list and will notify local law enforcement. The disarming actions include "Delete A/V, GPS data", which indicates that when the mobile application 102 is disarmed, the audio, video and location information recorded by the mobile application 102 is discarded after a predetermined period of time.

In other examples, instant alarm events can include "Pepper spray", which indicates that the mobile application 102 will enter an alarm state if the wireless sensor 152 has detected that the user 103 has discharged pepper spray, and "Gun drawn", which indicates that the mobile application 102 will enter an alarm state if the wireless sensor 152 has detected that the user 103 has removed their gun from its holster. Instant alarm actions can include "Notify nearby officers", which indicates that, during an alarm state, the monitoring center 116 will notify on-duty officers that are located near the user 103, and "Notify Dispatch", which indicates that, during an alarm state, the monitoring center 116 will notify local law enforcement dispatchers. Arming events can include "Geofencing", which indicates that the mobile application 102 will be armed if the user 103 is determined to have entered a predetermined geographical location (for example, if the mobile application 102 detects via the GPS receiver of the mobile computing device 104 that the user 103 is within a defined range of latitude and longitude coordinates). Expiration actions can include "Dispatch backup officers", which indicates that upon expiration of the armed status of the mobile application 102, backup officers will be dispatched by the monitoring center 116 to the location of the user 103.

The event log 122 stores information about potential security events, including an event ID, a pointer to the user ID of the involved user 103, a recorded start and end time of the potential security event, location information, an event type, which is a class of potential security events with customized arming and response settings, a reset count, which is the number of times during the potential security event that the armed state of the mobile application 102 was extended, a status description including whether the potential security event is ongoing, a list of actions taken by the monitoring center 116, a pointer to an incident report, and audio and video data received from the mobile application 102. In embodiments, the location data can include GNSS data, such as GPS coordinates, and/or address information.

In the illustrated example, Event2 involves the user 103 "EMP001." The potential security event started at "time3", was resolved at "time4", and was located at "Location1". The event type is "SOS-timer exp.", which indicates that the potential security event was reported to the monitoring center 116 by the mobile application 102 after the application was armed and then the armed status of the application was allowed to expire (for example, if the duress timer expired without being stopped or paused). The reset count is 0, which indicates that the armed state of the mobile application 102 was never extended. The status is "Complete", indicating that the potential security event has been resolved and is not ongoing. The actions taken include "Texted contacts" and "Called police", which indicates that the monitoring center 116 sent a text message to the contacts 134 in the user's 103 notification list informing them of the potential security event, and that the monitoring center 116 notified local law enforcement of the potential security event. In this example, there is no pointer to an incident reports, which indicates that there were no previously reported incidents in the incident report database 124 that were determined to be relevant to Event2. Finally, the audio and video data relevant to Event2 recorded by the mobile application 102 and forwarded to the monitoring center 116 are stored in Filet.

In other examples, the event type can include "Closing (late)", indicating that the mobile application 102 was armed by the user 103 during a closing sequence (for example, a bank employee closing a bank branch late at night and then walking to their car alone). A similar example is "Branch opening", indicating that the mobile application 102 was armed by the user 103 during the opening procedure (for example, a bank employee arriving at a bank branch in the morning and opening it). Other examples include "SOS-manual" indicating that the mobile application 102 entered an alarm state upon the user 103 pressing a predetermined sequence of virtual buttons 110, physical buttons 112 or wireless alarm buttons 156, "SOS-pep. spray", indicating that the mobile application 102 entered an alarm state upon the wireless sensor 152 detecting that the user 103 has discharged pepper spray, and "SOS-gun drawn", indicating that the mobile application 102 entered an alarm state upon the wireless sensor 152 detecting that the user 103 removed their gun from their holster.

The event type can determine the manner in which an alarm state is triggered, or the manner in which the monitoring center 116 responds. For example, the event type "Branch opening" may have an initial duress timer setting of fifteen minutes, whereas the event type "Closing (late)" may indicate an initial duress timer setting of five minutes, and an additional event type (not illustrated) "Property inspection" may indicate an initial duress timer setting of two hours. In a further example, the event type "SOS-gun drawn" may automatically dispatch nearby law enforcement officers to the location of the potential security event, whereas the event type "SOS-timer exp" may require the technician 130 to monitor the event data and attempt to make contact with the user 103 before notifying law enforcement.

The incident report database 124 includes information that is potentially relevant to potential security events such as an incident report ID, a time created, a time updated, a status, uploaded photographs, and a description entered by the user 103 submitting the incident report.

In one example, Report1 was created at "time14" and updated at "time15". The status is "Complete" indicating that the incident report has been resolved (for example, an investigation was conducted and no threat was determined to exist). The uploaded photos include "Photo1", and the description indicates that the user 103 witnessed a suspicious vehicle parked outside of a branch (for example, of a bank). In this example, a pointer to Report1 is included in the event log 122 for Event1, indicating that Report1 includes information that is relevant to Event1 in the event log 122.

Figure 3:
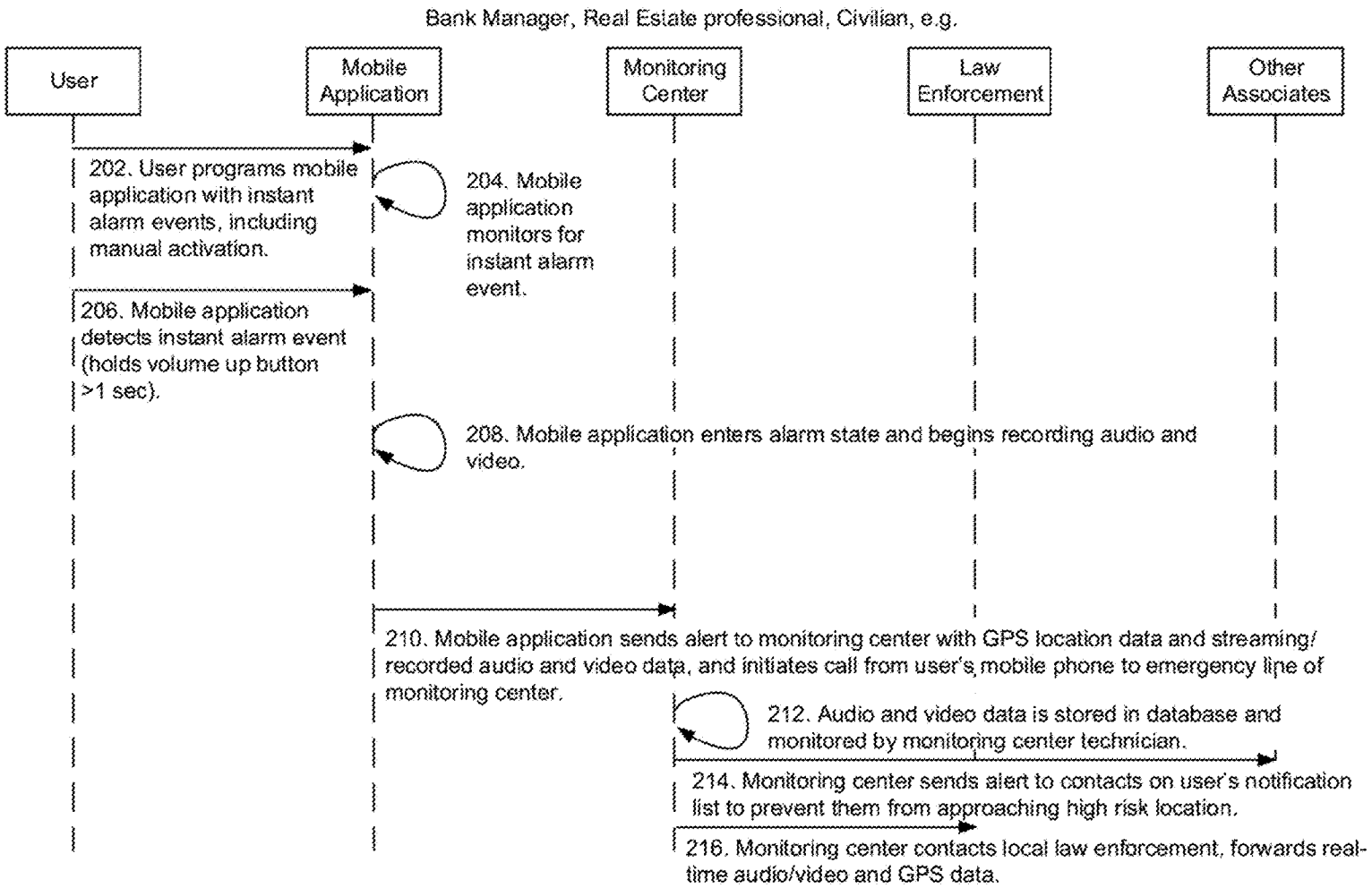
FIG. 3 is a sequence diagram illustrating a method employed by the mobile duress alarm system in the event that the user manually triggers an alarm event.

FIG. 3 is a sequence diagram illustrating the method for the mobile duress alarm system in the event that the user manually triggers an alarm event. In step 202, the user programs the mobile application 102 to include manual activation as an instant alarm event, and this setting is stored in the user profile database 120. In examples, manual activation can include pressing a virtual button 110 on the GUI 106 of the mobile application 102, pressing and holding a physical button 112 for a predetermined period of time (for example, pressing the volume up button on the mobile computing device 104 for greater than 1 second), or pressing the wireless Maim button 156. In step 204, the mobile application 102 monitors for detection of any instant alarm events. In step 206, the mobile application 102 detects an instant alarm event such as the user 103 holding the volume up button on the mobile computing device 104. In step 208, the mobile application 102 enters an alarm state and begins recording audio, video and location information. In step 210, the mobile application 102 sends an alert to the monitoring center 116 with event data including GPS location data and streaming and/or recorded audio and video data. The mobile application 102 also initiates a telephone call from the mobile computing device 104 to an emergency telephone line of the monitoring center 116. In step 212, the event data is stored in the event log 124 and monitored by a technician 130. In step 214, the monitoring center 116 sends an alert to notify contacts 134 on the user's 103 notification list that a potential security event is occurring or has occurred and to avoid approaching the area, for example. Finally, in step 216, the monitoring center 116 contacts and forwards real time event data to local law enforcement.

In one example, a bank employee leaving a bank branch late at night is attacked and holds down the volume up button on their smart phone, triggering the mobile application 102 to enter an alarm state and record audio and video data of the attack, as well as GPS location data. This event data is forwarded to the monitoring center 116, stored in the event log 122, and monitored by a technician 130. A text message is then sent to all employees of the bank branch informing them of the incident and warning them not to approach the bank branch. Local law enforcement is notified and provided with the event data by the monitoring center 116. Law enforcement officers arrive on the scene to intervene and use the event data provided by the monitoring center in their investigation of the incident.

Figure 4:
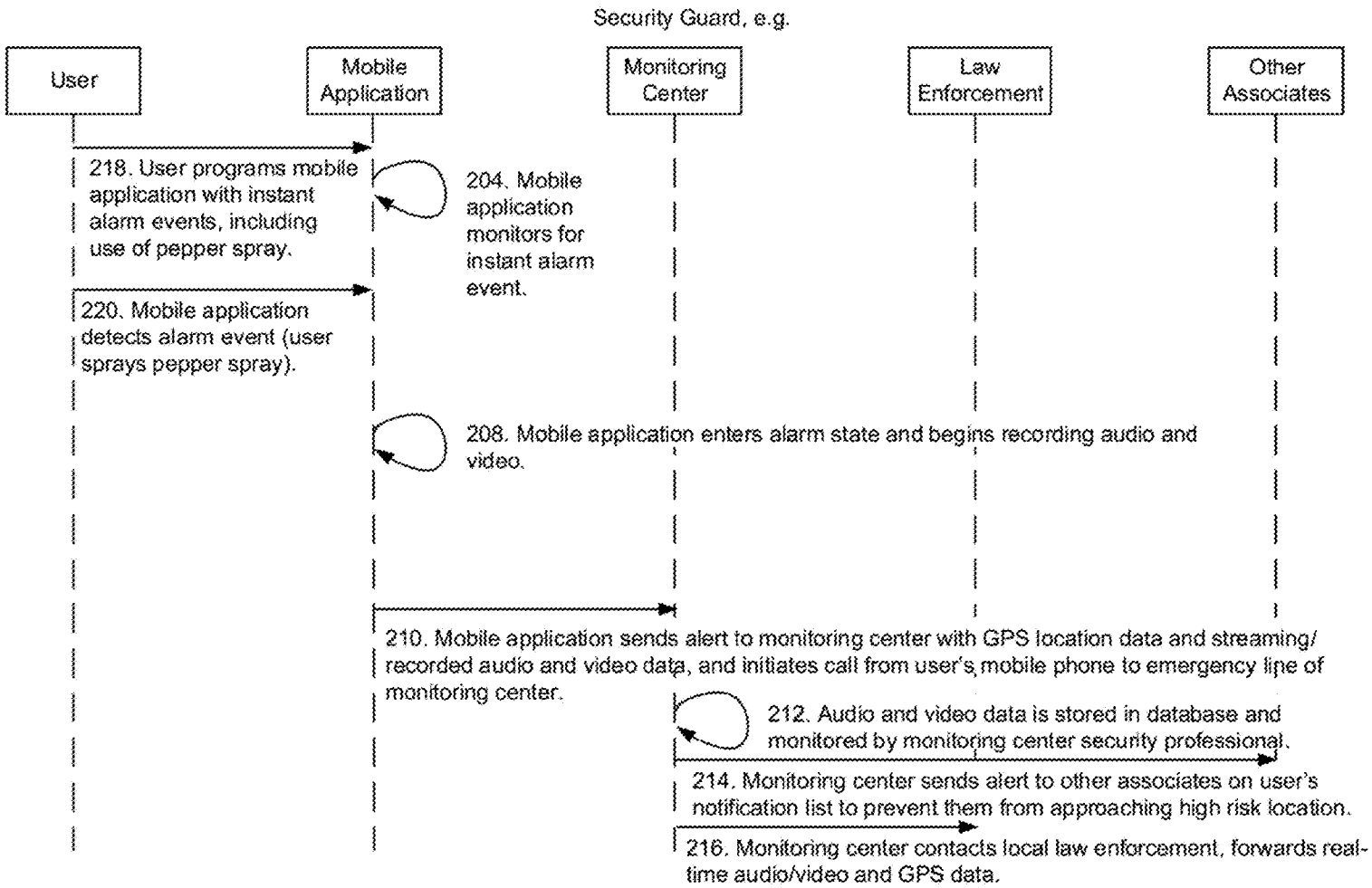
FIG. 4 is a sequence diagram illustrating a method employed by the mobile duress alarm system in the event that the user discharges pepper spray.

FIG. 4 is a sequence diagram illustrating the method for the mobile duress alarm system in the event that the user 103 discharges pepper spray. In step 218, the user 103 programs the mobile application 102 to include pepper spray as an instant alarm event, and this setting is stored in the user profile database 120. In step 204, the mobile application monitors for instant alarm events, and in step 220, an instant alarm event is detected when the wireless sensor 152 detects that pepper spray has been discharged. The rest of the method in steps 208 through 216 proceeds as previously described.

In one example, a security guard armed with pepper spray confronts and attempts to apprehend an intruder. During the confrontation, the security guard sprays pepper spray to subdue the intruder. Upon detection by the wireless sensor 152 that pepper spray has been discharged, the mobile application 102 enters an alarm state and forwards recorded event data the monitoring center 116. The monitoring center 116 monitors the event data, determines that backup is necessary, and calls local law enforcement on the security guard's behalf.

Figure 5:
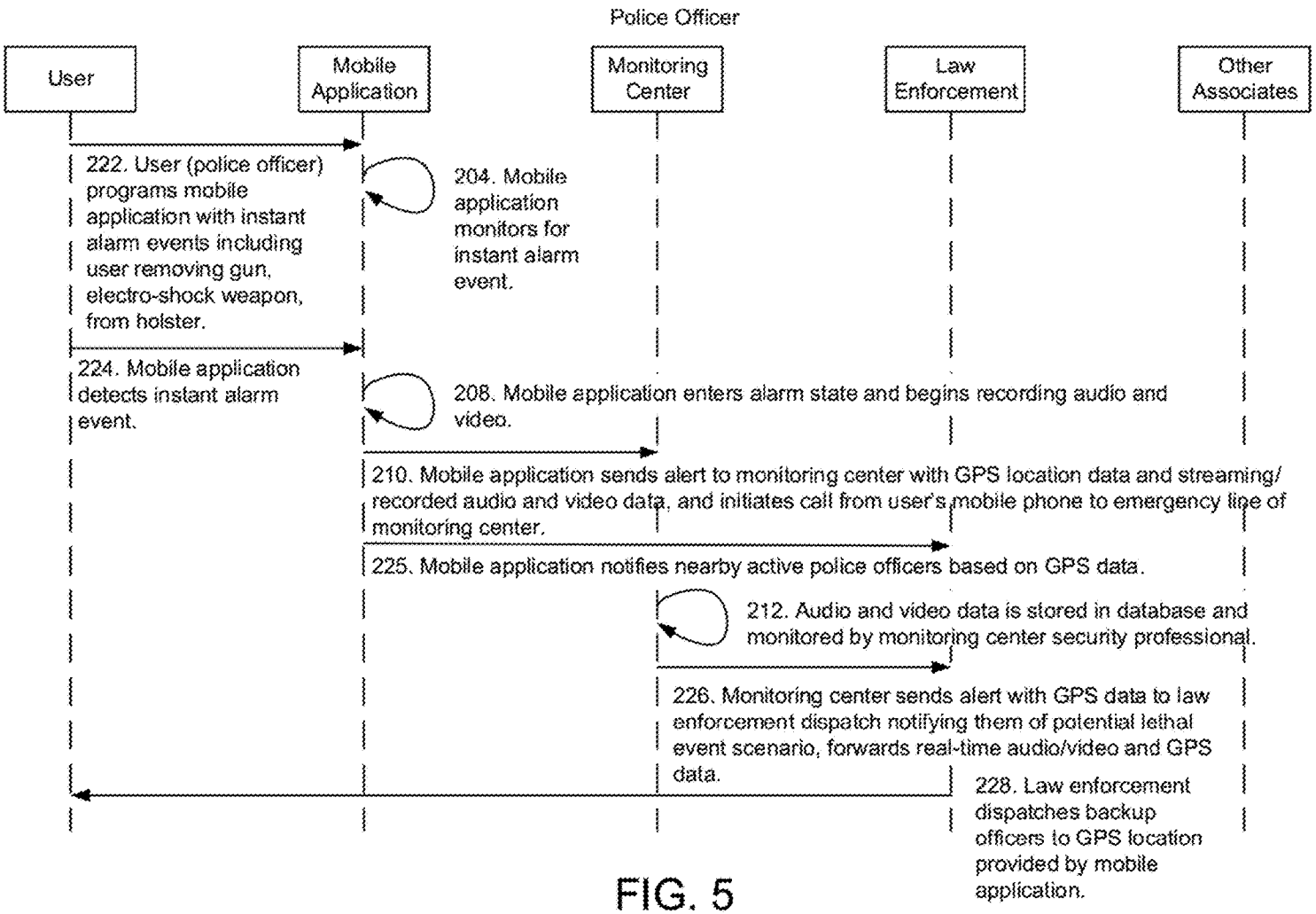
FIG. 5 is a sequence diagram illustrating a method employed by the mobile duress alarm system in the event that the user is a law enforcement officer and they remove their gun from its holster.

FIG. 5 is a sequence diagram illustrating the method for the mobile duress alarm system in the event that the user 103 is a law enforcement officer and they remove their gun from its holster. In step 222, the user 103 programs the mobile application 102 to include removing a weapon from its holster as an instant alarm event, and this setting is stored in the user profile database 120. The mobile application 102 detects an instant alarm event in step 224 when the user 103 removes their gun or electro-shock weapon from its holster. Event data is recorded and sent to the monitoring center. In step 225, the mobile application 102 notifies law enforcement officers that are determined to be nearby based on GPS data that a potential security event exists. In step 226, the monitoring center also alerts law enforcement dispatch and forwards the event data in real time. Finally, in step 228, law enforcement dispatch dispatches backup officers to the GPS location provided by the mobile application 102.

In one example, a police officer removes their gun from its holster in the process of apprehending a suspect. The wireless sensor 152 detects that the gun has been unholstered and the mobile application 102 enters an alarm state. Backup officers are automatically notified of the situation and arrive on the scene to provide backup. Law enforcement receives the event data from the monitoring center 116, monitors it in real time, dispatches further backup if necessary, and uses the event data in a subsequent investigation of the incident.

Figure 6:
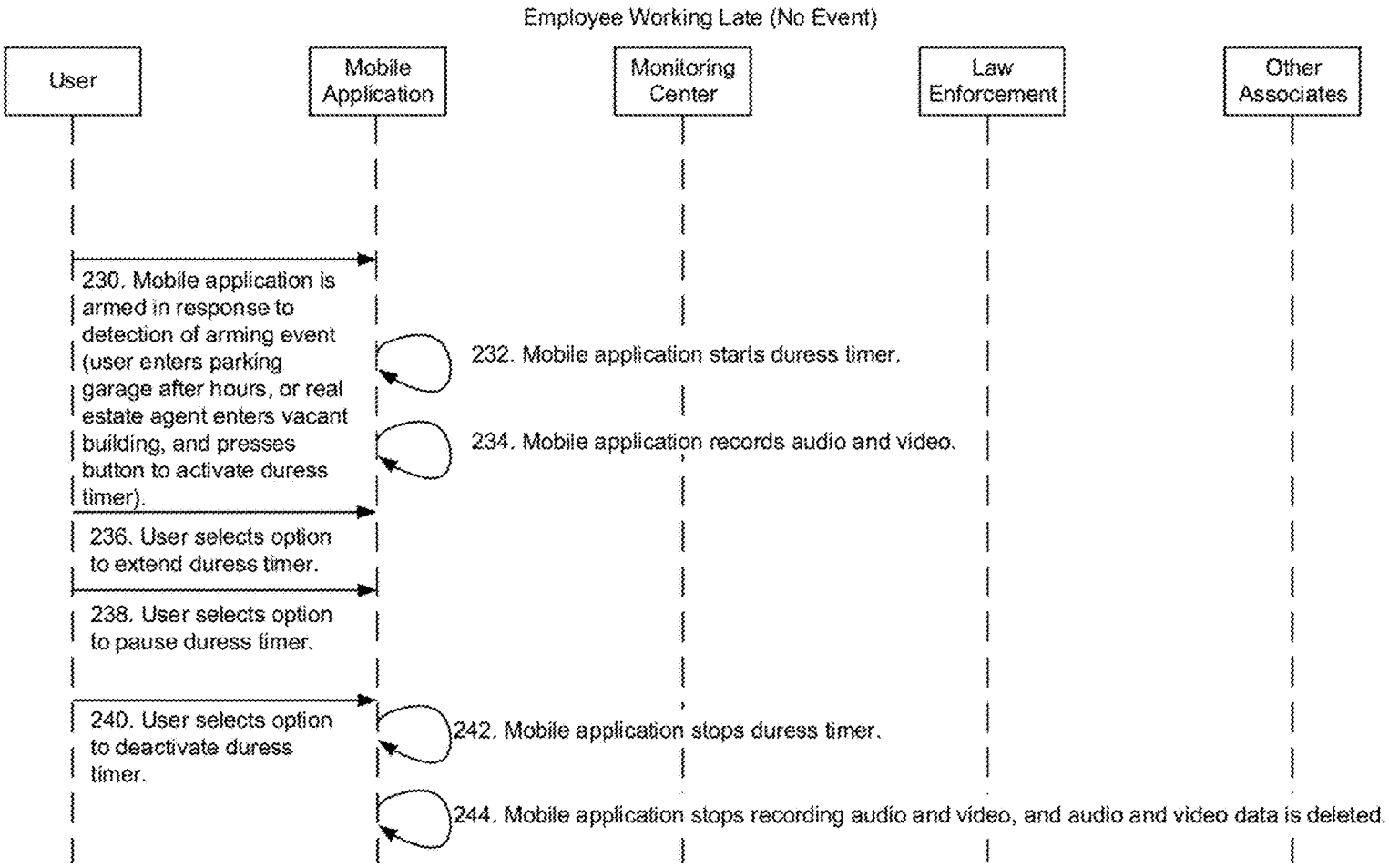
FIG. 6 is a sequence diagram illustrating a method employed by the mobile duress alarm system in the event that the mobile application becomes armed and then is disarmed by the user.

FIG. 6 is a sequence diagram illustrating the method for the mobile duress alarm system in the event that the mobile application 102 becomes armed and then is disarmed by the user 103. In step 230, the mobile application 102 is armed in response to the detection of an arming event associated with the user 103 in the user profile database 120. In step 232, the mobile application starts a duress timer, and in step 234, the mobile application 102 begins recording audio and video data. In step 236, the user 103 manually selects the option to extend the duress timer, thus providing additional time before the duress timer expires. In step 238, the user 103 selects an option to pause the duress timer, which subsequently stops counting down temporarily. In step 240, the user 103 selects an option to deactivate the duress timer, thus disarming the mobile application 102 and stopping the duress timer in step 242. Finally, in step 244 the mobile application 102, which has not entered an alarm state, stops recording event data, and the event data is deleted.

In one example, an employee of a company is returning to their car after working late at night. The employee arms the mobile application 102 by pressing a virtual button 110 on the GUI 106 of the mobile application 102. The duress timer is set at five minutes and begins counting down and recording audio and video data. When there is one minute left on the duress timer, the employee extends the duress timer, by pressing another virtual button 110. When the employee gets into their car safely, they press another virtual button 110 to deactivate the duress timer, indicating that no potential security event exists. As a result, the mobile application 102 stops recording audio and video data and deletes the audio and video data already recorded.

In another example, the mobile application 102 automatically detects that the employee is returning to their car using geofencing, and since it is later than a predetermined threshold of time, the mobile application 102 automatically becomes armed and starts the duress timer.

Figure 7:
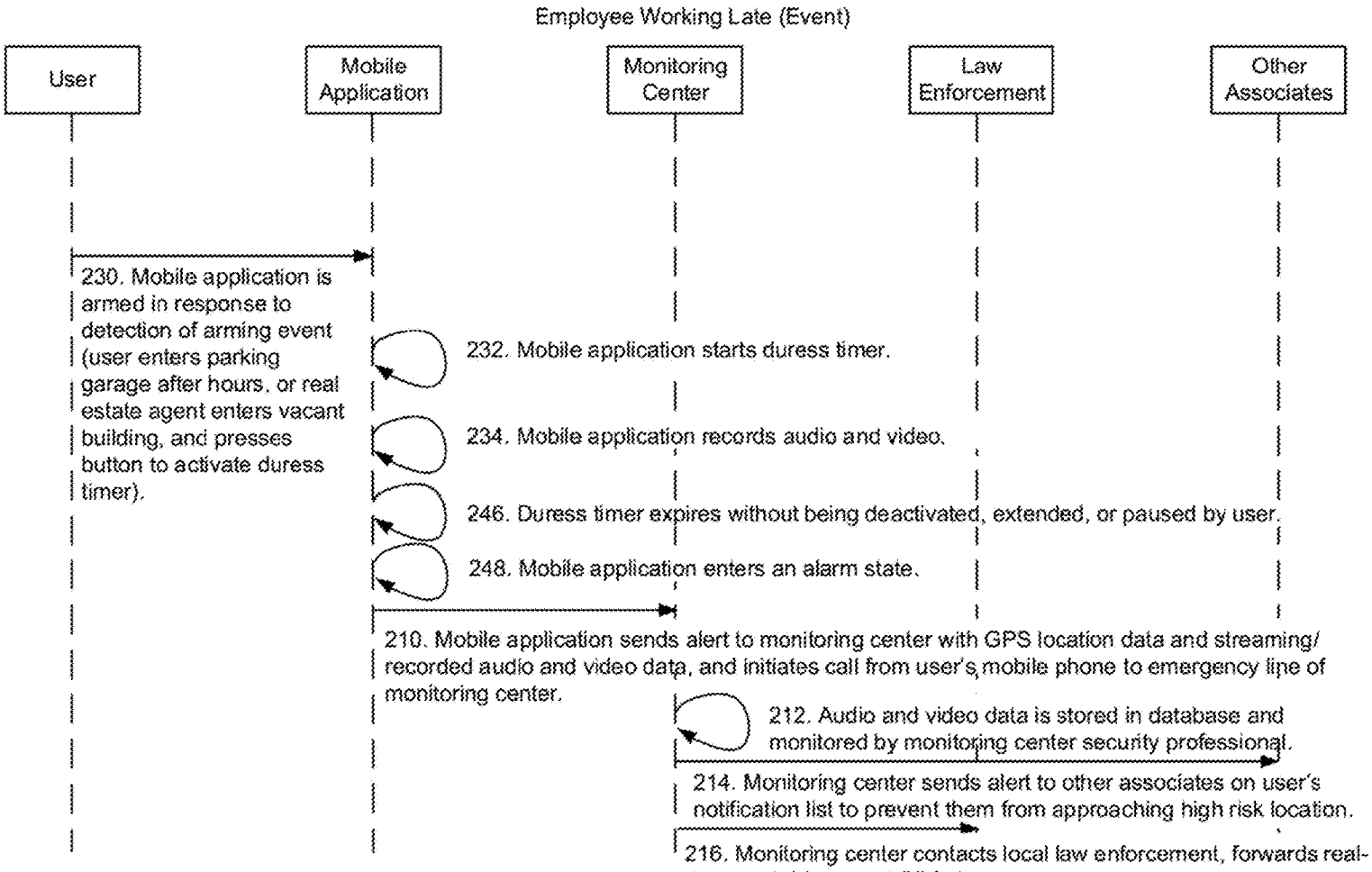
FIG. 7 is a sequence diagram illustrating a method employed by the mobile duress alarm system in the event that the user arms the mobile application and then allows the armed state of the mobile application to expire.

FIG. 7 is a sequence diagram illustrating the method for the mobile duress alarm system in the event that the user arms the mobile application and then allows the armed state of the mobile application to expire. Steps 230 through 234 proceed as previously described. However, in step 246, the duress timer expires without being deactivated, extended or paused by the user 103. As a result, the mobile application 102 enters an alarm state in step 248, and the monitoring center is notified as previously described in steps 210 through 216.

In this example, the employee returning to their car after working late arms the mobile application 102 as before. However, on their way to their car, the employee becomes incapacitated (for example, after being attacked). As a result, the duress timer expires, and the monitoring center 116 is notified and provided with recorded event data. Local law enforcement is then called and arrives on the scene to intervene.

Figure 8:
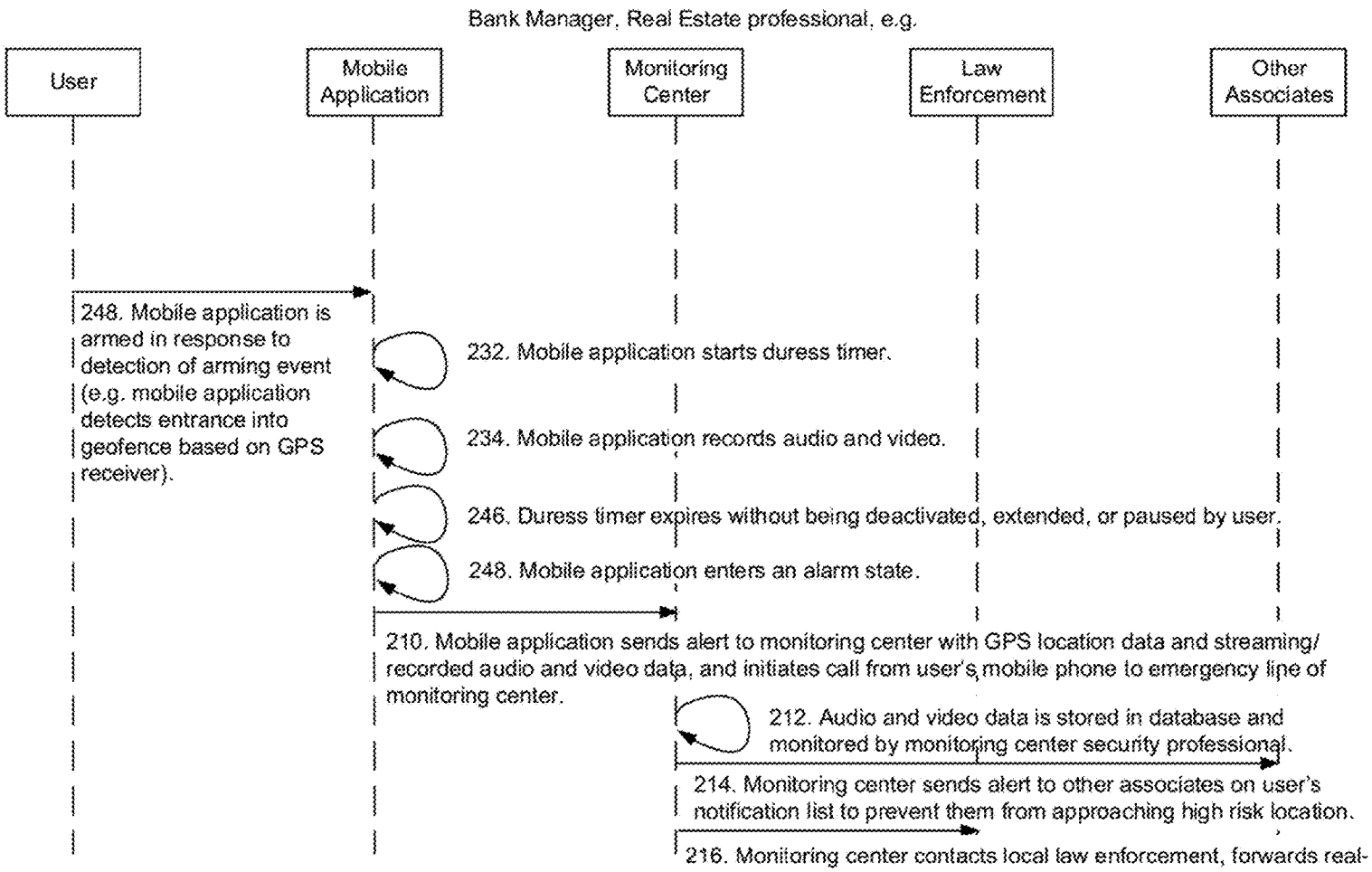
FIG. 8 is a sequence diagram illustrating a method employed by the mobile duress alarm system in the event that the duress timer is activated using geofencing and then allowed to expire.

FIG. 8 is a sequence diagram illustrating the method for the mobile duress alarm system in the event that the duress timer is activated using geofencing and then allowed to expire. In step 248, the mobile application 102 is armed in response to the detection of an arming event associated with the user 103 in the user profile database 120, specifically an arming event involving the detection by the mobile application 102 that the user 103 has entered a geofence. The mobile application 102 is armed as previously described in steps 232 and 234, and the duress timer expires and an alarm state is triggered as previously described in steps 246 and 248.

In one example, a real estate professional is inspecting a property known to be abandoned. Upon entering a predetermined range of geographical coordinates associated with the abandoned property, the mobile application 102 is armed automatically, and the duress timer is set to two hours. During the inspection, the mobile application 102 records audio and video data, lithe real estate professional completes the inspection with no issues, they would manually disarm the mobile application 102. However, if the real estate professional becomes incapacitated, the mobile application 102 will automatically enter an alarm state after two hours, and the monitoring center 116 will be notified, provided with recorded event data, and law enforcement would be notified and sent to the property to intervene.

FIGS. 9-17 illustrate an example of screens of the GUI 106 for both the mobile application 102 and for the monitoring center application 128 in one embodiment of the invention in which a bank uses the mobile duress alarm system to monitor employees completing a branch opening procedure.

Figure 9:
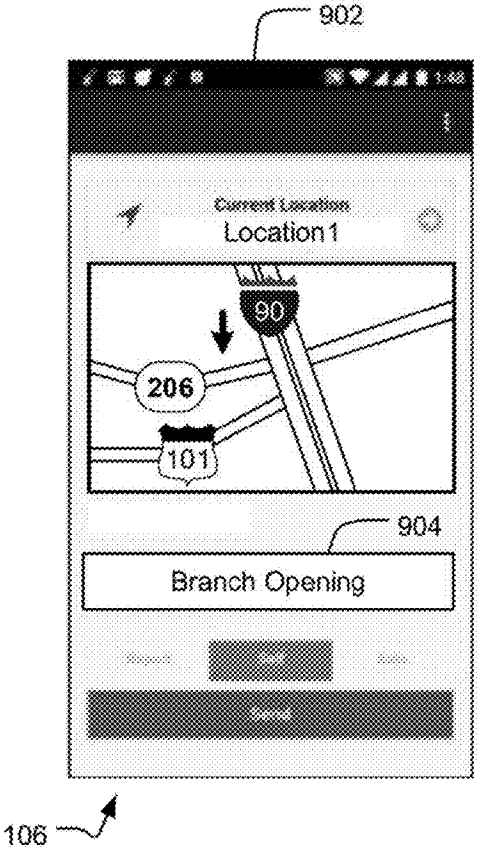
FIG. 9 shows the branch opening screen of the graphical user interface of the mobile application that is displayed on the touchscreen display of the mobile computing device.

FIG. 9 shows the branch opening screen 902. The current location, determined by the GPS receiver of the mobile computing device 104, is displayed on the top and in the middle of the screen, including a map pointing to the current location. The initiate branch opening button 904 is displayed on the bottom of the screen. When selected, the initiate branch opening button 904 starts the duress timer and advances to the duress timer screen 906.

Figure 10:
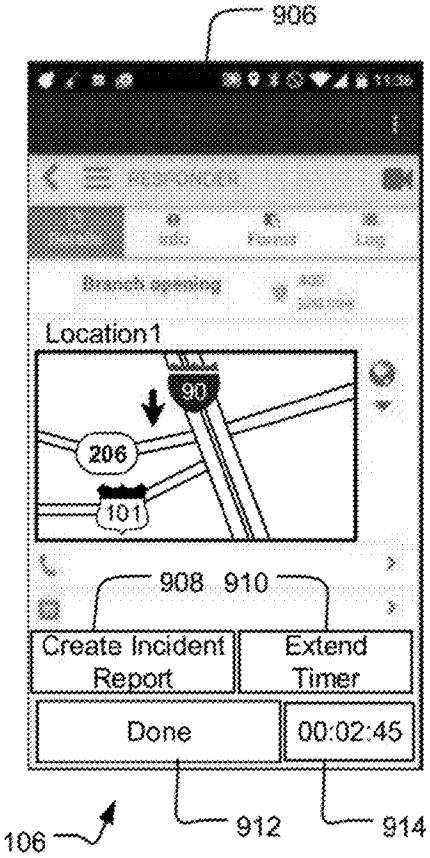
FIG. 10 shows the duress timer screen of the mobile application that is displayed on the touchscreen display of the mobile computing device.

FIG. 10 shows the duress timer screen 906, which is displayed when the initiate branch opening button 904 is selected. As on the branch opening screen 902, the current location is displayed. Also displayed is a create incident report button 908, an extend timer button 910, a done button 912, and a duress timer status text 914. When selected, the create incident report button 908 advances to the create incident report screen 916. The extend timer button 910 advances to the extend timer screen 918. The done button 912, when selected, stops the duress timer and disarms the mobile application 102. The duress timer status text 914 displays the number of minutes and seconds left before the duress timer expires and the mobile application 102 enters an alarm state.

Figure 11:
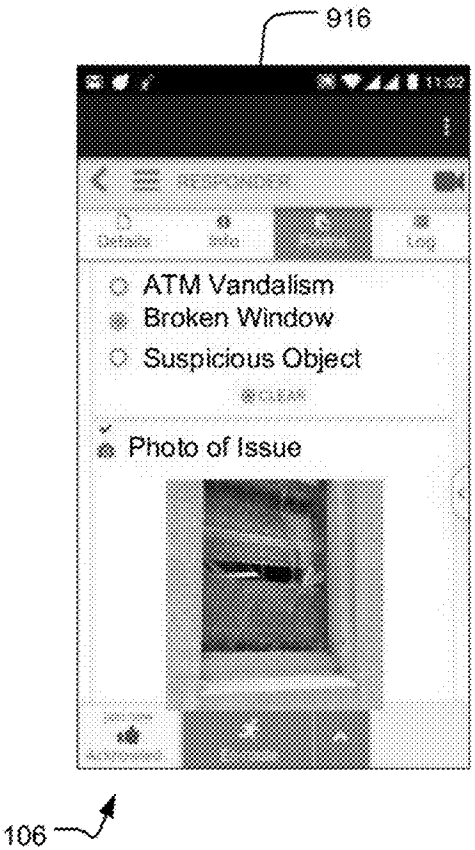
FIG. 11 shows the create incident: report screen of the mobile application that is displayed on the touchscreen display of the mobile computing device.

FIG. 11 shows the create incident report screen 916, which is displayed when the create incident report button 908 is selected. The create incident report screen 916 allows the user 103 to fill out one of a series of forms, including uploading a photo, and submit the form to the monitoring center 116 to be stored in the incident report database 124.

Figure 12:
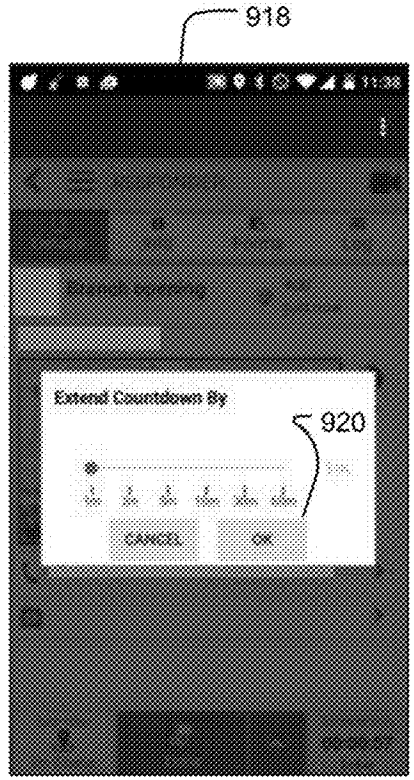
FIG. 12 shows the extend timer screen of the mobile application that is displayed on the touchscreen display of the mobile computing device.

FIG. 12 shows the extend timer screen 918, which is displayed when the extend timer button 910 is selected. The extend timer screen 918 includes multiple options for the amount of time by which to extend the duress timer that can be selected by the user 103 and an OK button 920. When selected, the OK button 920 extends the duress timer by the amount selected by the user 103.

Figure 13:
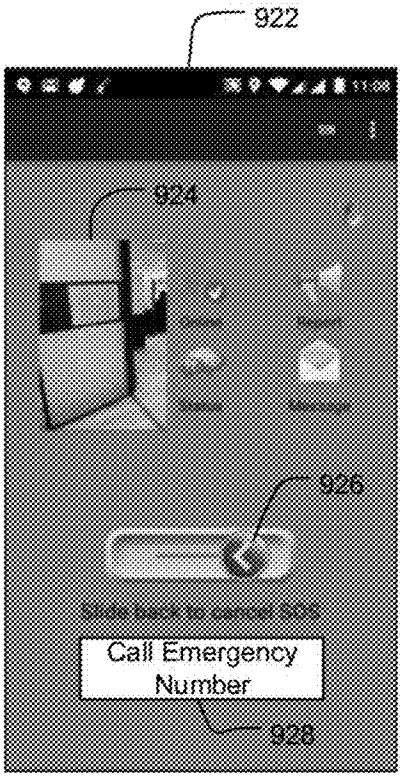
FIG. 13 shows the alarm state screen of the mobile application that is displayed on the touchscreen display of the mobile computing device.

FIG. 13 shows the alarm state screen 922, which is displayed when the duress timer expires and the mobile application 102 enters an alarm state. The alarm state screen 922 displays a real-time view of the video data being recorded 924, status information, a cancel slider graphic 926, which, when selected, cancels the alarm state, and a call emergency number button 928, which, when selected, initiates a call from the mobile computing device 104 to the emergency line of the monitoring center 116.

Figure 14:
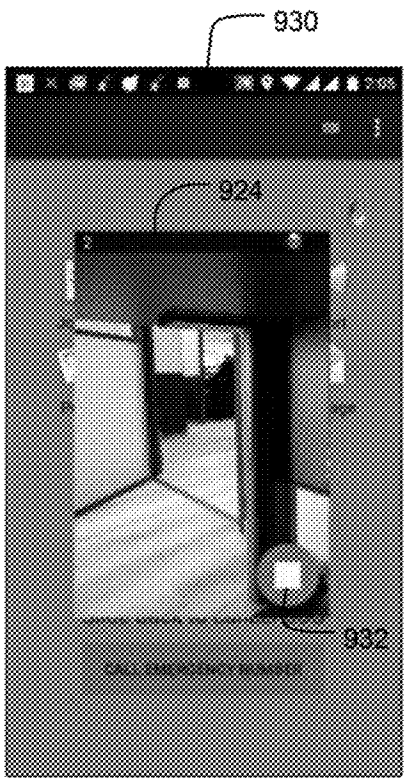
FIG. 14 shows the video recording screen of the mobile application that is displayed on the touchscreen display of the mobile computing device.

FIG. 14 shows the video recording screen 930, which is displayed when the real-time view of the video data being recorded 924 is selected by the user 103 on the alarm state screen 922. The video recording screen 930 provides an enlarged view of the real-time view of the video data being recorded 924 and also includes a stop button 932, which, when selected, causes the mobile application 102 to stop recording video data.

Figure 15:
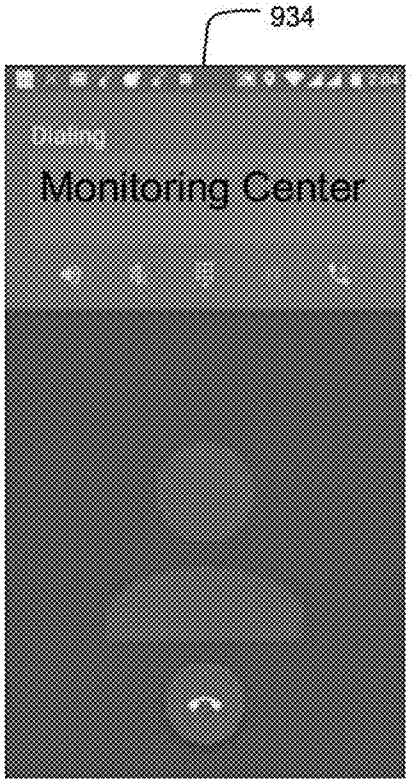
FIG. 15 shows the call emergency number screen of the mobile application that is displayed on the touchscreen display of the mobile computing device.

FIG. 15 shows the call emergency number screen 934, which is displayed when the call emergency number button 928 is selected on the alarm state screen 922. The call emergency number screen 934 can also be displayed if a telephone call to the emergency line of the monitoring center 116 is initiated automatically as part of the instant alarm actions or expiration actions stored associated with the user 103 in the user profile database 120.

Figure 16:
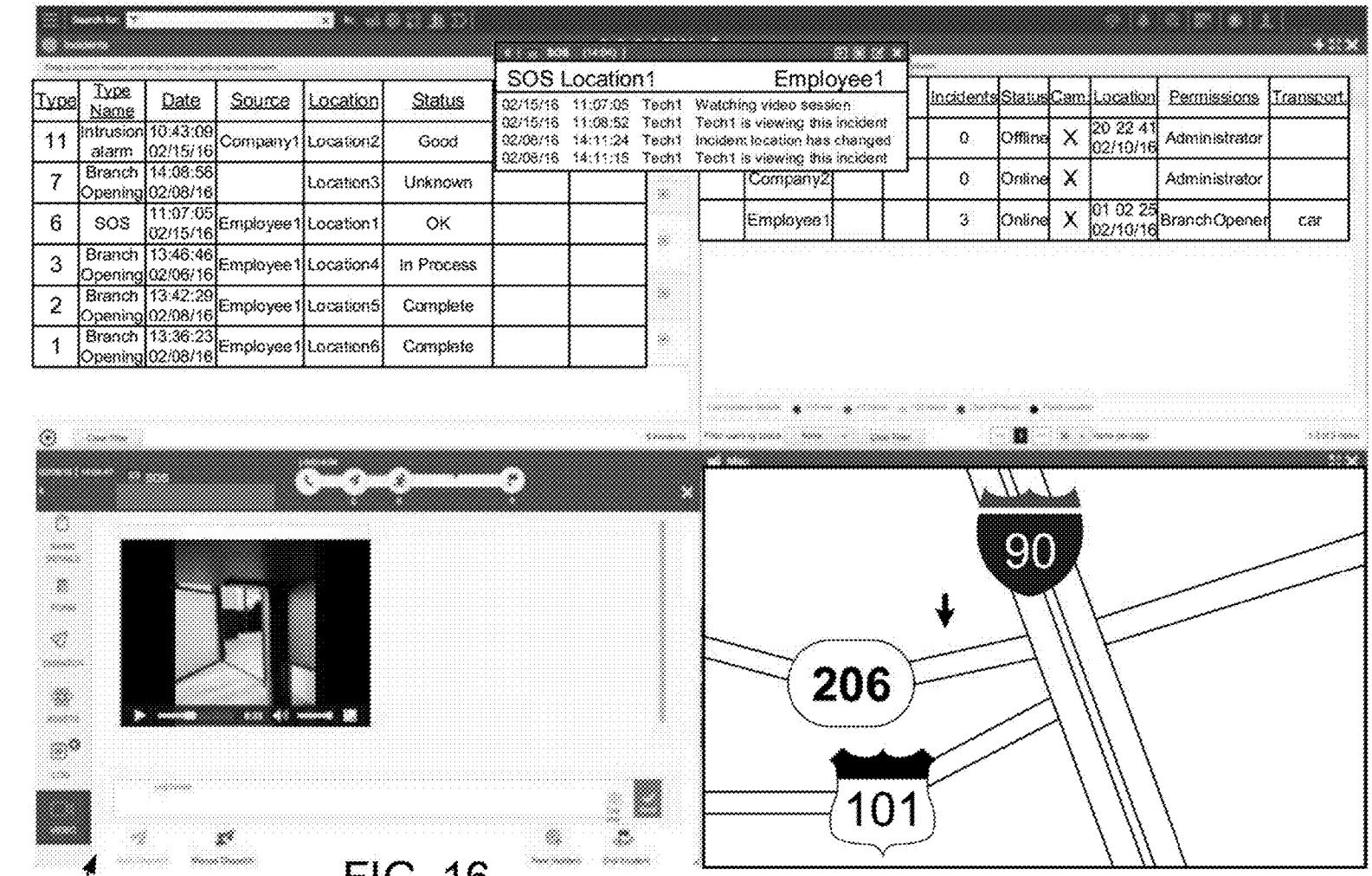
FIG. 16 shows a screen of the monitoring center application.

FIG. 16 shows a screen of the monitoring center application 128. The screen includes general status information for multiple ongoing and completed potential security events, along with detailed status information for a selected potential security event. The detailed status information includes real-time and recorded video and audio data and a map displaying the current location of the potential security event.

Figure 17:
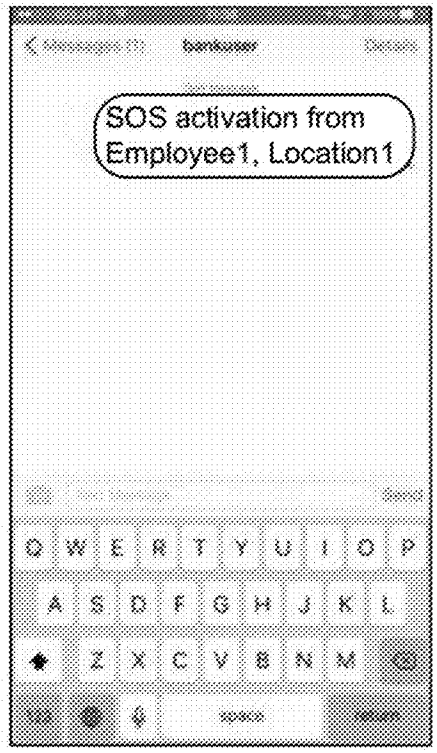
FIG. 17 illustrates an example of a screen of a mobile computing device of a contact after the contact has received an alert text message from the monitoring center of the mobile application that is displayed on the touchscreen display of the mobile computing device.

FIG. 17 illustrates an example of a screen of the mobile computing device 104 of one of the contacts 134, after the contact has received an alert message from the monitoring center 116. In this example, the contact has received a text message from the monitoring center 116.

Figure 18:
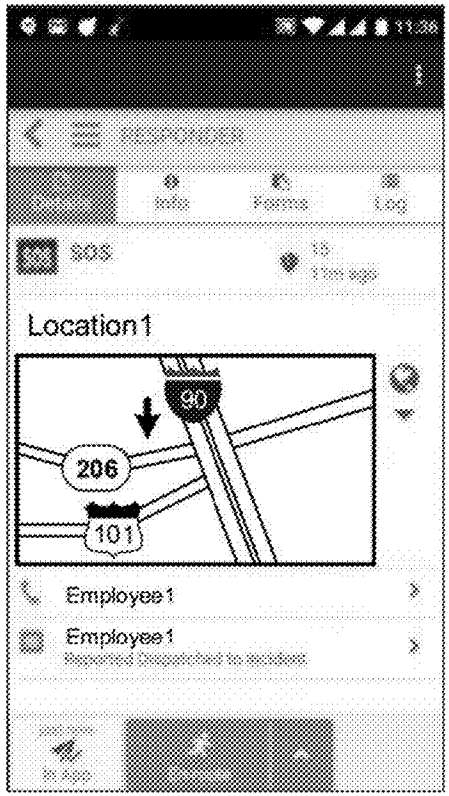
FIG. 18 illustrates an example of a screen of a mobile computing device of a contact after the contact has received an alert message from the monitoring center via the mobile application of the mobile application that is displayed on the touchscreen display of the mobile computing device.

FIG. 18 illustrates an example of a screen of the mobile computing device 104-1 of once of the contacts 134-1, after the contact has received an alert message from the monitoring center 116. In this example, the contact has received a message via the mobile application 102-1.

While this invention has been particularly shown and described with references to preferred embodiments thereof, it will be understood by those skilled in the art that various changes in form and details may be made therein without departing from the scope of the invention encompassed by the appended claims.

What is claimed is:

1. A method for responding to potential security events comprising:

specifying one or more arming events, expiration actions, and disarming actions for a user;

a mobile application executing on a mobile computing device of the user detecting the specified arming events for the user, starting recording event data including recording audio and video data by the mobile computing device in response to detecting the specified arming events for the user, buffering the recorded event data including the audio and video data recorded by the mobile computing device, executing the specified disarming actions for the user in response to determining that the mobile application was disarmed by the user within a predetermined time period including stopping recording the audio and video data and deleting the recorded audio and video data; and executing the specified expiration actions for the user in response to determining that the mobile application was not disarmed by the user within the predetermined time period including sending the recorded audio and video data to the monitoring center and streaming recorded audio and video data to the monitoring center.

2. The method according to claim 1, wherein the arming events include manual activation by pressing one or more buttons on the mobile computing device.

3. The method according to claim 1, wherein the arming events include the mobile computing device entering a predefined geographic area, which is detected by the mobile application through the use of geo-fencing.

4. The method according to claim 1, wherein the event data includes audio, video and global navigation satellite system location data recorded by the mobile application.

5. The method according to claim 1, wherein the monitoring center stores the event data in response to the mobile application being armed and not being disarmed within a predetermined time period.

6. The method according to claim 1, wherein the expiration actions include notifying a specified list of contacts for the user of the potential security event.

7. The method according to claim 1, wherein the expiration actions include notifying law enforcement of the potential security event.

8. The method according to claim 1, in which the monitoring center is a law enforcement agency, and the set of expiration actions includes dispatching backup law enforcement officers to the location of the potential security event.

9. The method according to claim 1, further comprising providing the recorded event data to law enforcement entities investigating the potential security events.

10. The method according to claim 1, further comprising the mobile application initiating a call from a mobile phone of the user to an emergency line of the monitoring center in response to determining that the mobile application was not disarmed by the user within the predetermined time period.

11. A mobile duress alarm system comprising:

a mobile computing device of a user executing a mobile application for detecting specified arming events for the user, starting recording event data including recording audio and video by the mobile computing device in response to detecting the specified arming events for the user, the mobile computing device executing specified disarming actions for the user in response to determining that the mobile application was disarmed by the user within a predetermined time period including stopping recording the audio and video data and deleting the recorded audio and video data, the mobile computing device in response to determining that the mobile application was not disarmed by the user within the predetermined time period sending the recorded audio and video data to a monitoring center and streaming recorded audio and video data to the monitoring center; and the monitoring center for receiving the event data including the recorded audio and video data and executing specified expiration actions for the user in response to determining that the mobile application was not disarmed by the user within the predetermined time period.

12. The system according to claim 11, wherein the mobile application is armed in response to the user pressing one or more buttons on the mobile computing device.

13. The system according to claim 11, wherein the mobile application is armed in response to the mobile computing device entering a predefined geographic area, which is detected by the mobile application based on data received by a global navigation satellite system receiver of the mobile computing device.

14. The system according to claim 11, wherein the event data includes audio, video and global navigation satellite system location data recorded by the mobile application.

15. The system according to claim 11, wherein the monitoring center stores the event data in response to the mobile application being armed and not being disarmed within a predetermined time period.

16. The system according to claim 11, wherein the monitoring center notifies a specified list of contacts for the user of the potential security event in response to the mobile application being armed and not being disarmed within a predetermined time period.

17. The system according to claim 11, wherein the monitoring center notifies law enforcement of the potential security event in response to the mobile application being armed and not being disarmed within a predetermined time period.

18. The system according to claim 11, wherein the monitoring center is a law enforcement agency, and the monitoring center dispatching backup law enforcement officers to the location of the potential security event in response to the mobile application being armed and not being disarmed within a predetermined time period.

19. The system according to claim 11, wherein the monitoring center provides the recorded event data to law enforcement entities investigating the potential security events in response to the mobile application being armed and not being disarmed within a predetermined time period.

20. The system according to claim 11, wherein the mobile application initiates a call from a mobile phone of the user to an emergency line of the monitoring center in response to determining that the mobile application was not disarmed by the user within the predetermined time period.

* * * * *